US005406967A

United States Patent [19]

Eberle

[11] Patent Number: 5,406,967

[45] Date of Patent: Apr. 18, 1995

[54] PAINT BRUSH CLEANING DEVICE

[76] Inventor: John J. Eberle, 1135 Austin Way, Napa, Calif. 94558

[21] Appl. No.: 68,056

[22] Filed: May 27, 1993

[51] Int. Cl.[6] ..... B08B 3/04

[52] U.S. Cl. ..... 15/104.92; 15/142; 15/201; 134/182

[58] Field of Search ..... 134/88, 182, 183, 201, 134/900; 15/104.92, 142

[56] References Cited

U.S. PATENT DOCUMENTS

| | | | |
|---|---|---|---|
| 577,362 | 2/1897 | Ettlinger . | |
| 1,233,417 | 7/1917 | Stephan . | |
| 3,837,091 | 9/1974 | Meyer | 134/900 |
| 4,823,424 | 4/1989 | Allen | 134/182 |
| 4,865,188 | 9/1989 | Custeau | 134/201 X |
| 5,005,598 | 4/1991 | Hodgdon | 134/900 |
| 5,163,459 | 11/1992 | Bailey | 134/900 |
| 5,184,637 | 2/1993 | Kowis | 134/182 |

FOREIGN PATENT DOCUMENTS

| | | | |
|---|---|---|---|
| 2949554 | 6/1981 | Germany | 134/900 |

*Primary Examiner*—Frankie L. Stinson
*Attorney, Agent, or Firm*—Harold D. Messner

[57] ABSTRACT

The present invention relates to a paint brush cleaning device in which a paint brush is located through an exit region of an elongated cavity of a nozzle-like housing, the exit region defining an inner area which is much larger than that of the entry region through which the cleaning fluid, viz., water enters the cylindrical sectional. The cylindrical neck section includes a hub having an interior side wall surface threaded for connection to a conventional garden hose, a central region that includes a valve for control of the passage of water and a throat region that marks the intersection between the cylindrical neck section and a flared exitway of which the exit region previously mentioned is associated. The flared exitway serves a dual purpose: (i) in a first direction looking toward the cylindrical section from the exit region of the flared exitway, the exitway is formed of a flared construction relative to the axis of symmetry of the device to capture the ends of the bristles of the brush along a banded section thereof. Result: a gentle repositioning of the bristles toward the axis of symmetry of the device occurs during the cleaning process and (ii) in a second direction opposite to the first, the exitway allows the water to expand outwardly through the flared entryway whereby the water passes through the bristle ends and then to the heel in paths that permit easy and gentle cleaning of paint from the bristles, whether the latter uses a water-base or oil-base solvent as the paint carrier.

4 Claims, 2 Drawing Sheets

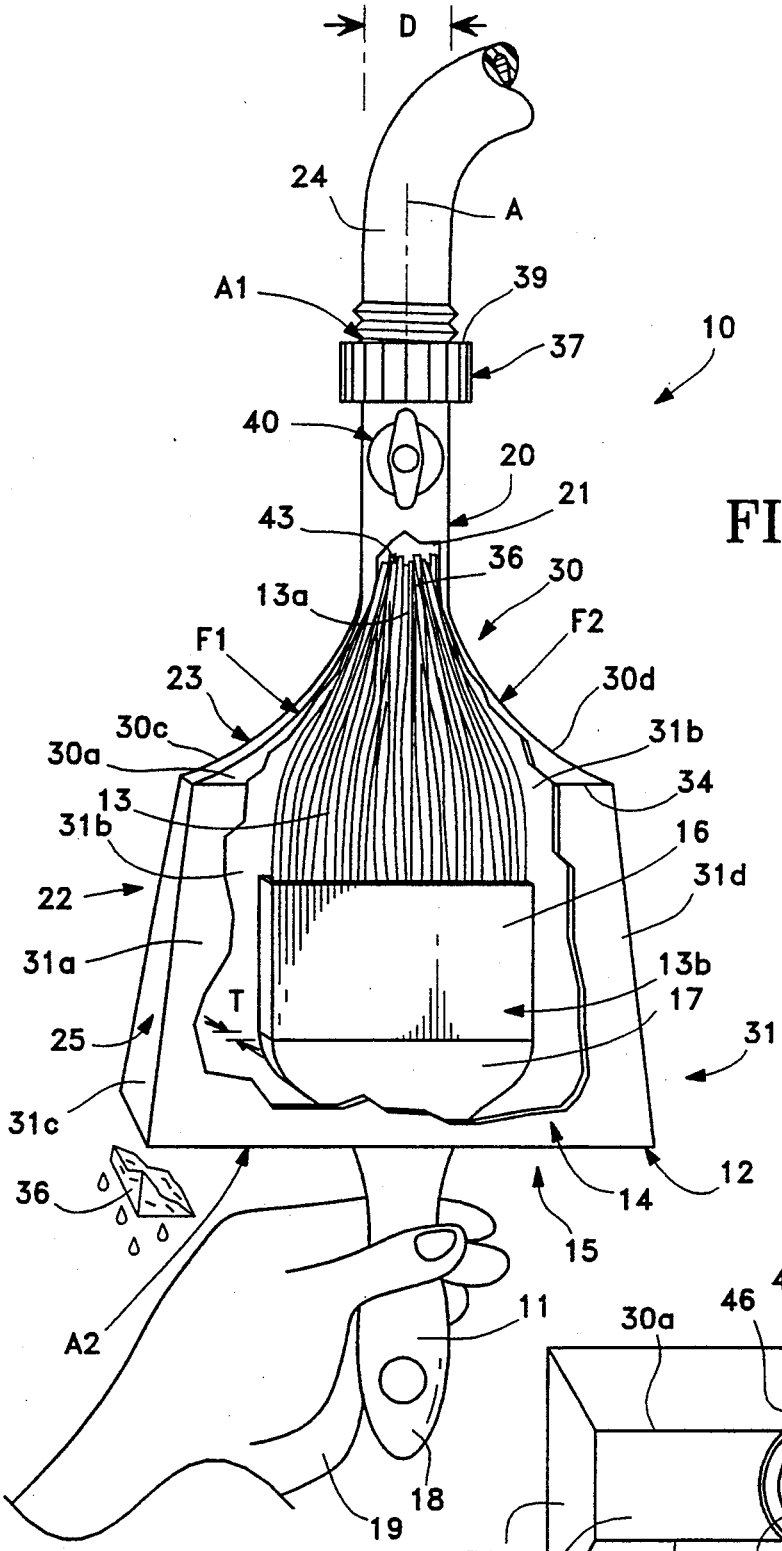
FIG. 1
FIG. 4
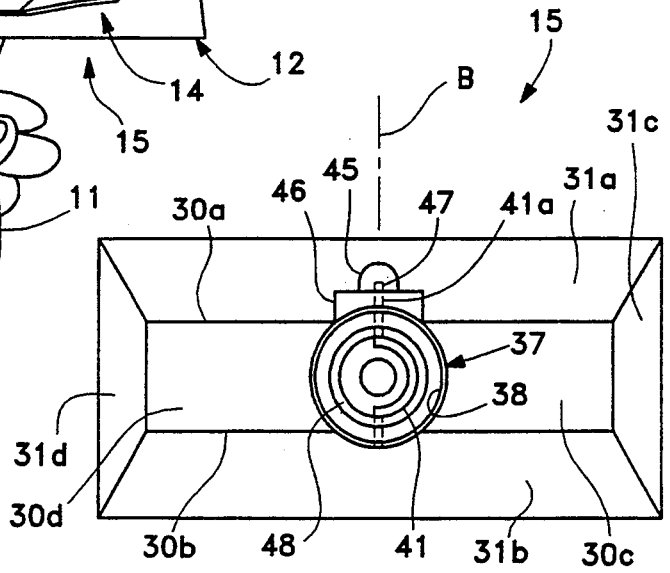

PAINT BRUSH CLEANING DEVICE

SCOPE OF THE INVENTION

The present invention relates to paint brush cleaning device and more particularly to a water-driven paint brush cleaning device in which the brush to be cleaned is located in an elongated cavity which both captures a band of bristles at their free ends and gently repositions them toward the axis of symmetry of the device whereby water entering along the axis of symmetry upstream of the brush passes through the free ends of the bristles and thence toward and about the heel ends of the bristles, so as to remove the paint quickly and gently from the brush.

BACKGROUND OF THE INVENTION

Paint brush cleaning devices for a multiplicity of paint brushes is claimed and described in U.S. Pat. No. 4,912,797 for "Paint Brush Cleaning Device" having a housing having multiple openings for accepting a series of paint brushes along the lid of the housing. The ends of the brushes contact a rotating roller means along the circumference of the latter while jet nozzles direct cleaning fluid toward the heels of the bristles.

However, since the bristles are unsupported at their ends, there is tendency for the bristles to spread as a result of the cleaning process. Therefore, there is a need for a paint brush cleaning device which supports the bristles so a prevent bristle spreading as the brush is cleaned, especially where such device also accepts a multiplicity of different sized brushes one-at-a-time as would more likely occur where the user is a casual user and not a professional painting crew.

SUMMARY OF THE INVENTION

The present invention relates to a paint brush cleaning device in which a paint brush is located through an exit region of an elongated cavity of a nozzle-like housing in which the bristles of the brush point toward a cylindrical neck section of circular cross section, the inner area of which is much smaller than that of the enlarged exit region through which the brush extends (and the cleaning fluid, viz., water exits after entry through the cylindrical section). The cylindrical neck section includes a hub having an interior side wall surface threaded for connection to a conventional garden hose, a central region that includes a valve for control of the passage of water and a throat region that marks the intersection between the cylindrical neck section and a flared exitway of which the exit region previously mentioned is associated. The flared exitway serves a dual purpose: (i) in a first direction looking toward the cylindrical section from the exit region of the flared exitway, the exitway is formed of a flared construction relative to the axis of symmetry of the device to capture the ends of the bristles of the brush along a banded section thereof. Result: a gentle repositioning of the bristles toward the axis of symmetry of the device occurs during the cleaning process and (ii) in a second direction opposite to the first, the exitway allows the water to expand outwardly through the flared entryway whereby the water passes through the bristle ends and thence to the heel in paths that permit easy and gentle cleaning of paint from the bristles, whether the latter uses a water-base or oil-base solvent as the paint carrier.

Among objects and advantages provided by the present the invention includes the provision of a device that is successful with cleaning both water-base and oil-base paint from the bristles of a multiplicity of different sizes of paint brushes without injury to the bristles via sidewise spreading using economical manufacturing techniques of a simple and straight forward manner.

These objects and advantages together with others will become subsequently apparent, and moreover reside in the details of construction and operation of the present invention as more fully described and claimed hereinafter, reference being had to the accompanying drawings forming a part hereof, wherein like numerals refer to like parts throughthrough.

BRIEF DESCRIPTION OF THE DRAWINGS

FIG. 1 is a perspective view of the device of the present invention, partially cut-away, in operation to clean a paint brush held within an elongated cavity by the user's hand in which the flow of water from the enlarged end of the cavity toward the user's hand, is schematically shown;

FIGS. 2, 3 and 4 are plan, side and end views, respectively, of the device of the invention in which the conventional garden hose and paint brush of FIG. 1 have been removed.

DETAILED DESCRIPTION OF THE INVENTION

Figure 2:
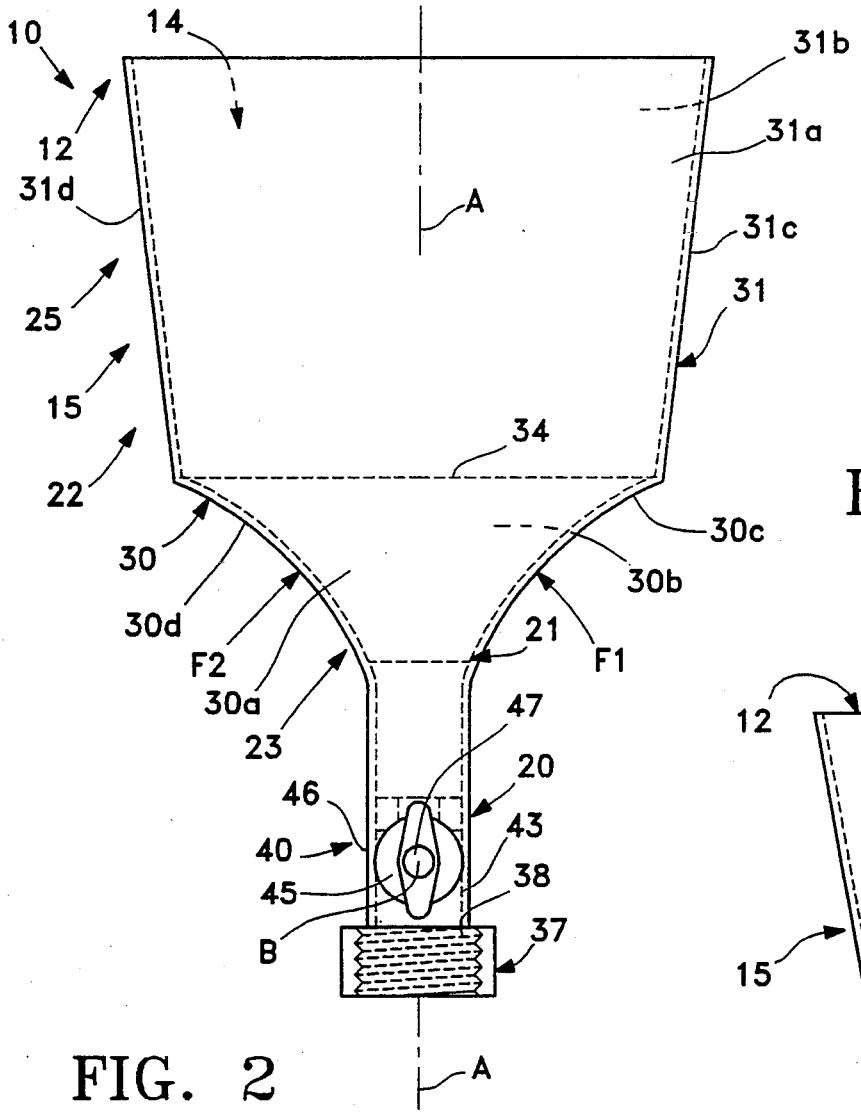

Referring to FIG. 1, there is shown a paint brush cleaning device 10 of the present invention in which a paint brush 11 (to be cleaned) has been inserted through an enlarged exit region 12 wherein bristles 13 of the brush 11 are fully located within elongated cavity 14 within nozzle-like housing 15. The device 10 is preferably formed of a one-piece construction using a plastic molding process with minor mechanical additions occurring as noted below.

The paint brush 11 is conventional wherein the bristles 13 include free ends **13*a* opposite to heel ends 13*a* attached to and secured within a metal ring 16. The ring 16, in turn, attaches to enlarged hub 17 which in turn is attached to reduce sized handle 18 by which the user grips the brush 11, viz., using his hand 19**.

Besides the elongated cavity 14, the nozzle-like housing 15 also includes the following: (i) an axis of symmetry A, (ii) a cylindrical neck section 20 that is of circular cross section, concentric of the axis A of the housing 15, and includes a throat region 21 forming the terminus of the section 20, and (iii) a dual angled, flared exitway 22. Note that the throat region 21 is positioned adjacent to the free ends **13*a* of the bristles 13, and marks the intersection between the cylindrical section 20 and the dual angled flared exitway 22** as previously mentioned.

The flared exitway 22 of the device 10 includes a first upstream region 23 (relative to the flow of water from garden hose 24 entering through the exiting from the cylindrical section 20) and a second downstream exit region 25.

Figure 3:
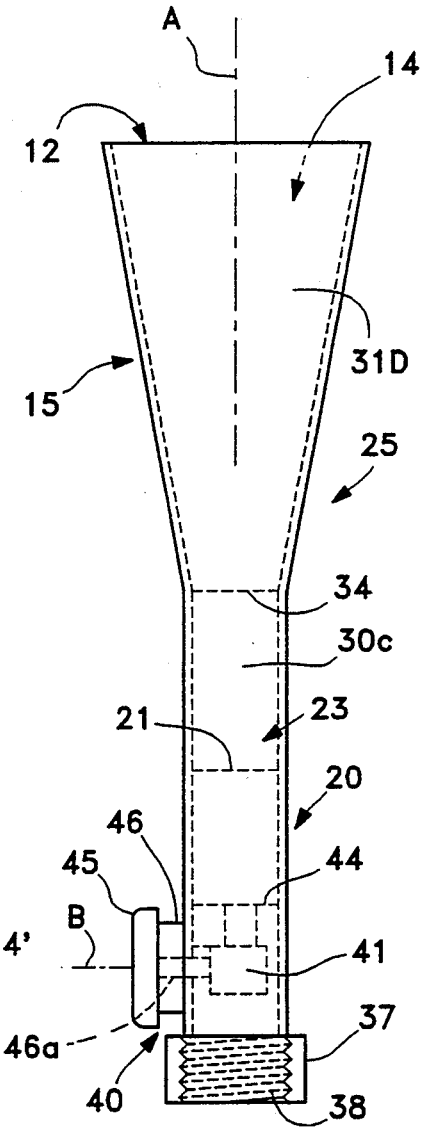

As shown in FIGS. 2–4, the first upstream region 23 of the dual angled exitway 22 includes four adjacent walls generally indicated at 30 that form an upstream portion of the cavity 14. The four walls 30 include triangularly shaped broad walls 30*a*, 30*b* (parallel to each other) and curved transverse walls 30*c* and 30*d* curved outwardly relative to the axis of symmetry A of the device 10. Note that the shape of the transverse walls 30*c*, 30*d* define sets of centers of formation associated with axis F1 and axis F2, respectively and are seen to be exterior of the cavity 14 of the housing 15 (see FIG. 2).

The second downstream exit region 25 includes four walls generally indicated at 31 and include broad walls 31*a*, 31*b* and transverse walls 31*c*, 31*d*. The walls 31 are shaped to form a series of rectangles in cross section in which the rectangles change uniformly in size with respect to positions along the axis of symmetry A as shown in FIG. 3. That is, such rectangles change from a maximum at exit region 12, previously mentioned, and at a minimum at intersection 34 between first upstream region 23 and second exit region 25.

Note in FIG. 1 that the free ends 13*a* of the bristles 13 point toward the cylindrical section 20 to initially contact water generally indicated at 36 exiting from the throat region 21 of the cylindrical section 20.

As shown best in FIGS. 2–4, the cylindrical section 20 also includes an enlarged hub 37 that is concentric of axis of symmetry A opposite to the throat region 21. Such enlarged hub 37 has an interior side wall surface 38 threaded for connection to male connector 39 of the garden hose 24 (see FIG. 1). Between the enlarged hub 37 and throat region 21 is a ON-OFF flow valve 40.

The flow valve 40 includes a concavely shaped, rectangularly planar stopper 41 (see FIGS. 3 and 4) that rotates about a axis B normal to axis of symmetry A. The shape of the stopper 41 is matched to half of the inside circumference of the cylindrical section 20 so that when the stopper 41 is rotated to be parallel to the side wall 43 of the section 20 as shown in FIG. 4, water is permitted to flow through the section 20 (ON position). But when rotated to be transverse to the side wall 43, the stopper 41 blocks water flow relative to the section 20 (OFF position). In such OFF position, the stopper 41 is position adjacent to constrictor 44, see FIG. 3. Rotation of the stopper 41 is via controller cap 45 atop an integrally formed cupola 46. The controller cap 45 is attached to a reduced hub 41*a* of the stopper 41 (see FIG. 4) by means of a threaded connector 47 so that rotation of the cap 45 relative to the cupola 46 is translated directly to rotation of the stopper 41. As shown in FIG. 4, an O-ring 48 is attached concentrically of axis of symmetry A for water-tight attachment to the garden hose 24 of FIG. 1.

Assembly of the controller cap 45 to the stopper 41 within the cylindrical section 20 occurs after the housing 15 (with cupola 48) has been molded. The threaded connector 47 is inserted through the cap 45 into attachment with the reduced hub 41*a* of the stopper 41. Then the O-ring 48 is inserted within the hub 37.

In operation, if the brush 11 of FIG. 1 has been utilized to paint with water base paint and the painting operation has been completed, the brush 11 is inserted telescope-style, through enlarged exit region 12 of the flared exitway 22 herein bristles 13 of the brush 11 are fully located within the cavity 14 of the housing 15, in the manner of FIG. 1.

That is, the free ends 13*a* of the bristles 13 are inwardly forced toward the axis of symmetry A of the device 10 by the shape of curved walls 30*c*, 30*d* of the upstream region 23 of the dual angled exitway 22.

Then, water 36 under pressure is admitted to the cylindrical section 20 via the garden hose 24 (assuming proper orientation of the valve 40 to an ON position). The water 36 then is brought through the throat region 21 of the section 20 into contact with the free ends 13*a* of the bristles 13. Note that the bristles 13 are held against sideways spreading by the inward shape of the curve walls 30*c*, 30*d* of the upstream region 23 of the flared exitway 22. Such spreading is prevented even though a portion of the water 26 flared outwardly along the same curved walls 31*c*, 31*d* and thence exits via the downstream exit region 25. However, note that other portions of the water 36 follow more linear paths parallel to the axis of symmetry A and impact the heel ends 13*b* of the bristles to clean the entire length of the bristles 13 quickly and efficiently. Of course, the downstream exit region 25 can be positioned over a suitable drain or receptacle to receive the water 36 exiting from the device 10 of the invention along with the diluted paint residue previously located on the bristles 13.

If the brush 11 has been utilized to paint with an oil base paint, the brush 11 should first be inserted in container of paint thinner, such as turpentine and may thereafter be positioned within the device 10 of the invention in the manner of FIG. 1. Water 36 is then admitted to the cylindrical section 20 via the garden hose 24 (assuming proper orientation of the valve 40 to an ON position) in the manner previously mentioned. The water 36 exits through the throat region 21 of the section 20 into contact with the free ends 13*a* of the bristles 13 and through pressure impact, remove the paint residue from the bristles 13. Again, since the bristles 13 are held against sideways spreading by the inward shape of the curve walls 30*c*, 30*d* of the upstream region 23 of the flared exitway 22, spread of the bristles 13 is subsequent usage is prevented. Such spreading is prevented even though a portion of the water 36 flares outwardly along the same curved walls 30*c*, 30*d* and thence exits via the downstream exit region 25. However, note that other portions of the water 36 follow more linear paths parallel to the axis of symmetry A and impact the heel ends 13*b* of the bristles 13 to clean the entire length of the bristles 13. Again, the downstream exit region 25 should be positioned over a suitable drain or receptacle to receive the water 36 and oil-base paint residue (and thinner) exiting from the device 10. By first inserting the brush 11 into paint thinner, the residue of paint on the bristles 13 will be sufficiently diluted to enable the high pressure passage of the water 36 to flush same from the bristles 13.

Utilizing the device 10 of the invention in the manner described above, provides for the cleaning of the paint brush 11 in a rapid and efficient manner. Moreover, because the large variation in the transverse dimensions of the device 10 in the vicinity of the throat region 21, many sizes of brushes 11 can be cleaned in series, say up a maximum determined by the maximum transverse width of the upstream region 23 of the exitway 22, via., at intersection 34, see FIGS. 1–3. While brushes 11 that are smaller in transverse width than the diameter of the cylindrical section 20 can be cleaned, the pressure of the water 36 must be reduced to prevent undue spreading of the bristles 13. In this regard, if the maximum dimension of the throat region is X then bristles 13 having a transverse width of 0.5+X can be inwardly pressurized by the shape of walls 30*c*, 30*d* to gain the advantages of the invention described above.

Figure 5:
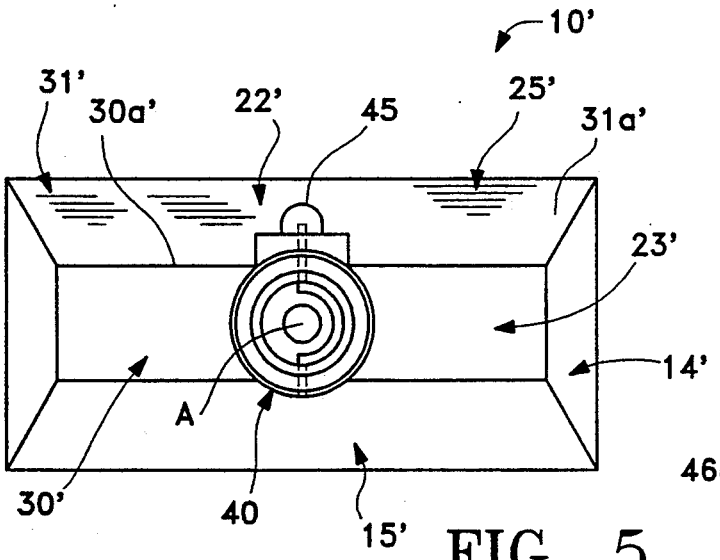
FIG. 5 is an end view of a second embodiment of the invention in which a portion of the enlarged cavity is provided with see-through, translucent walls to allow the user in view of the cleaning of the paint brush without periodically having to remove same from the device.

FIG. 5 illustrates how another embodiment of the device 10' of the invention can be formed to further increase efficiency in the cleaning process. Note in this embodiment that all or certain of the walls 30, 31 of the dual angled exitway 22' of the device 10' can be translucent so that the user can view the cleaning of the paint brush without removing same from the device 10'. Of particular note would be use translucent material for at least broad walls 30a', 31a' of the upstream and downstream regions 23', 25', respectively in the event the molding process does not permit such walls to be so molded as a group. Such as occurrence would require that the broad walls 30a', 31a' be mechanically added to the device 10' after the other six walls have been molded as a group. Moreover, since the valve controller cap 45 of the valve 40 is on the same side as the clean walls 30a', 31a', the user can stop the flow of water 36 when the cleaning process has been completed. In that way, undue discharge of the water 36 from the exitway 22' of the device 10' is avoided.

The foregoing is considered as illustrative only of the principles of the invention. Further, since numerous modifications and changes will readily occur to those skilled in the art, it is not desired to limit the invention to the exact construction and operations shown and described above but by the metes and bounds of the following claims.

What is claimed is:

1. A combination for cleaning oil-base or water-base paint residue from a paint brush, said combination including a paint brush having a multiplicity of bristles coated with oil-base or water-base paint residue and a paint brush cleaning device, said bristles of said paint brush including free ends extending from a rectangularly shaped base of transverse thickness T, said paint brush cleaning device comprising an elongated housing defining a longitudinal axis of symmetry and including a cavity longitudinally extending therealong having axially alignable first and second openings, said first opening having a diameter D defining a circular area A1 and said second opening having lateral and transverse dimensions defining a rectangular area A2, wherein A2>A1, said second opening being sufficiently large to permit entry of said base and said bristles of said paint brush into said cavity, said cavity adjacent to said second opening including planar walls defining first and second regions whose shape flares inwardly along said axis of symmetry beginning at said second opening, said inwardly flaring of said first region being both in transverse and lateral directions to permit said base of said paint brush to enter into said cavity even though said transverse thickness T of said base is greater than diameter D of said first opening, said inward flaring of said second region being in said lateral direction only to direct pressurized water unto said free ends of said bristles while simultaneously inwardly pressuring said free ends of said bristles toward said axis of symmetry, said housing including a neck section associated with said first opening and a flared exitway associated with said first and second regions, said first opening of said neck section threadably engaging a garden hose to permit water under pressure to enter said cavity via said first opening and exit said cavity via said second opening, said second region of said flared exitway being integrally connected to said neck section at a throat region concentric of said axis of symmetry wherein said planar walls thereof integrally attached about said axis of symmetry to provide both one-dimensional divergence of said pressurized water exiting from said neck section, said first and second regions of said flared exitway being integrally attached to each other at an intersection of rectangular cross section normal to said axis of symmetry, said planar walls of said first region being four in number and including two broad walls that diverge outwardly from said intersection with said second region relative to said axis of symmetry in opposite directions and two transverse walls attached to said broad walls at said intersection of said first and second regions, said transverse walls also diverging in opposite directions beginning from said intersection with respect to said axis of symmetry, said planar walls being translucent to permit viewing of said brush to aid in cleaning said oil-base or water-base residue from said bristles via said pressurized water.

2. The combination of claim 1 in which said neck section is cylindrical-like and includes an annular hub at one end of said neck section having threads at an interior surface for attachment to said garden hose, said combination further comprising an ON-OFF valve positioned in a central region of said neck section between said annular hub and said throat region whereby pressure of said water can be regulated in conjunction with viewing through said translucent walls for cleaning said oil-base or water-base residue from said bristles as well as reduce undue spreading of said bristles.

3. A paint brush cleaning device for cleaning oil-base or water-base paint residue from bristles of a paint brush having a base of transverse thickness T, comprising an elongated funnel-like housing defining a longitudinal axis of symmetry and including a cavity longitudinally extending therealong having axially alignable first and second openings, said first opening having a diameter D defining a circular area A1 and said second opening having lateral and transverse dimensions defining a rectangular area A2, wherein A2>A1, said second opening being sufficiently large to permit entry of a base and bristles of a paint brush into said cavity, said cavity adjacent to said second opening including planar walls defining first and second regions those shape flares inwardly along said axis of symmetry beginning at said second opening, said inwardly flaring of said first region being both in transverse and lateral directions to permit said base of said paint brush to enter into said cavity even though its transverse thickness T is greater than diameter D of said first opening, said inward flaring of said second region being in said lateral direction only to direct pressurized water unto free ends of said bristles while simultaneously inwardly pressuring said free ends of said bristles toward said axis of symmetry, said housing including a neck section associated with said first opening and a flared exitway associated with said first and second regions, said first opening of said neck section including inlet means to permit water under pressure to enter said cavity via said first opening and exit said cavity via said second opening, said second region of said flared exitway being integrally connected to said neck section at a throat region concentric of said axis of symmetry wherein said planar walls thereof integrally attached about said axis of symmetry to provide for both one-dimensional divergence of said pressurized water exiting from said neck section on and about said bristles of said paint brush and inner pressuring of free ends of said bristles toward said axis of symmetry whereby permanent spreading of said bristles is avoided, said first and second regions of said flared exitway being integrally attached to each other at an intersection of rectangular cross section normal to said axis of symmetry, said planar walls of said first region being four in number and including two broad walls that diverge outwardly from said intersection with said second region relative to said axis of symmetry in opposite directions beginning at said intersection of said first and second region and two transverse walls attached to said broad walls at said intersection, said transverse walls also diverging in opposite directions beginning from said intersection with respect to said axis of symmetry, said planar walls being translucent to permit viewing of said brush to aid in cleaning said oil-base or water-base residue from said bristles via said pressurized water.

4. The paint brush of claim 3 in which said neck section is cylindrical-like and in which said inlet means includes an annular hub at one end of said neck section having threads at an interior surface for attachment to said garden hose, said paint brush further comprising an ON-OFF valve positioned in a central region of said neck section between said annular hub and said throat region whereby pressure of said water can be regulated in conjunction with viewing through said translucent walls for cleaning oil-base or water-base residue from paint bristles as well as reduce undue spreading of said bristles.

* * * * *